US005288274A

United States Patent [19]

Bell et al.

[11] Patent Number: 5,288,274

[45] Date of Patent: Feb. 22, 1994

[54] KNIFE

[76] Inventors: Harry H. Bell, Box 323, Delhi, Calif. 95315; George R. Wegener, 306 Virginia Ave., Modesto, Calif. 95453

[21] Appl. No.: 910,724

[22] Filed: Jul. 8, 1992

[51] Int. Cl.[5] ..... A63J 23/00

[52] U.S. Cl. ..... 472/52; 222/78; 42/54; 472/69

[58] Field of Search ..... 472/69, 67, 52; 30/123.3; 446/197; 42/54; 222/78, 79

[56] References Cited

U.S. PATENT DOCUMENTS

| | | | |
|---|---|---|---|
| 2,453,525 | 11/1948 | McNeil | 30/123.3 |
| 2,826,859 | 3/1958 | Shaffer | 472/52 X |
| 3,132,859 | 5/1964 | Braunhut | 472/69 X |
| 3,756,467 | 9/1973 | Anketell | 222/78 |
| 4,597,527 | 7/1986 | Sands | 222/79 X |
| 4,864,759 | 9/1989 | Ferri | 42/54 |

*Primary Examiner*—Carl D. Friedman
*Assistant Examiner*—Kien Nguyen
*Attorney, Agent, or Firm*—Leon Gilden

[57] ABSTRACT

A novelty knife for use for simulating impact includes a resilient blade formed of shape retentive material having a bottom edge and a fluid reservoir bulb mounted as a handle, wherein the fluid reservoir bulb includes fluid communication through a plurality of conduits directed through the blade and exiting along the blade's lower edge adjacent the blade's tip, with a fluid dye contained within the reservoir for ease of replenishment.

3 Claims, 4 Drawing Sheets

FIG 3
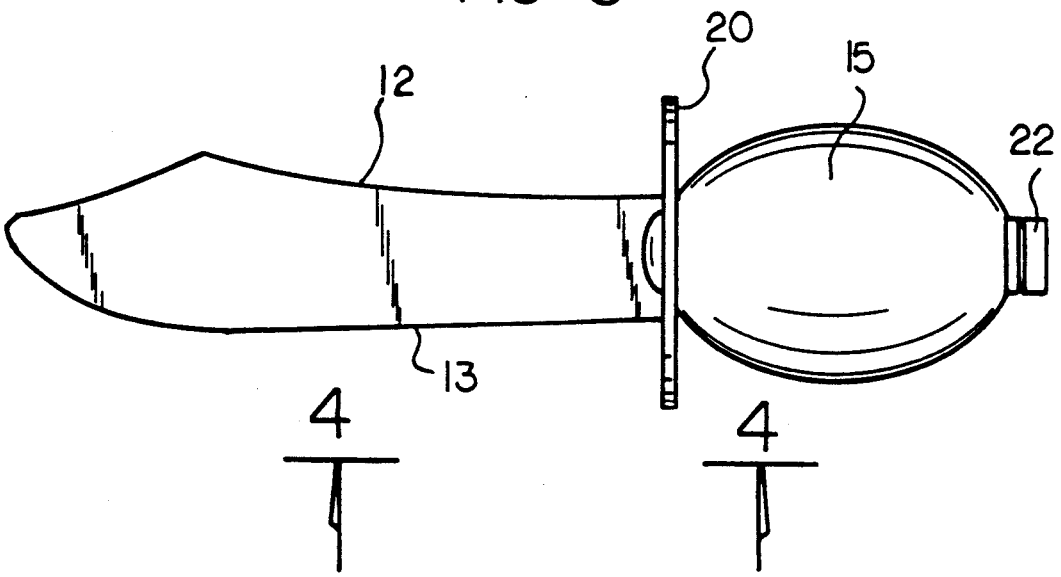
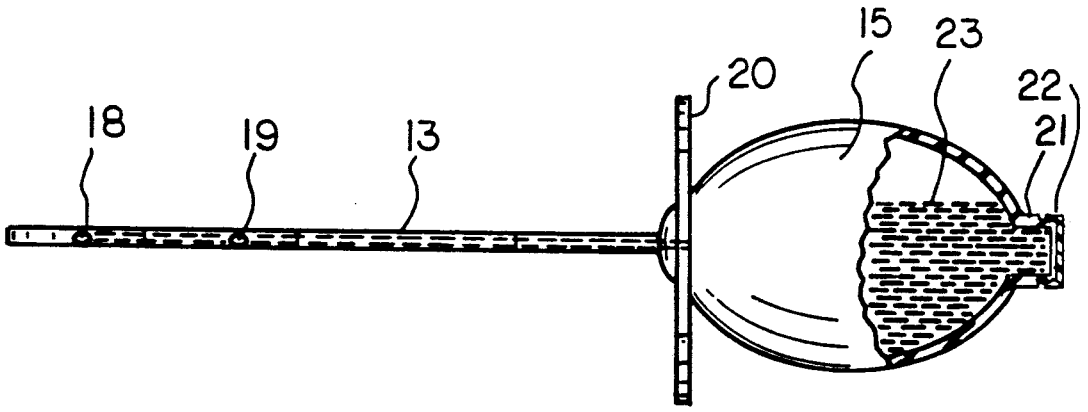
FIG 4

FIG 8
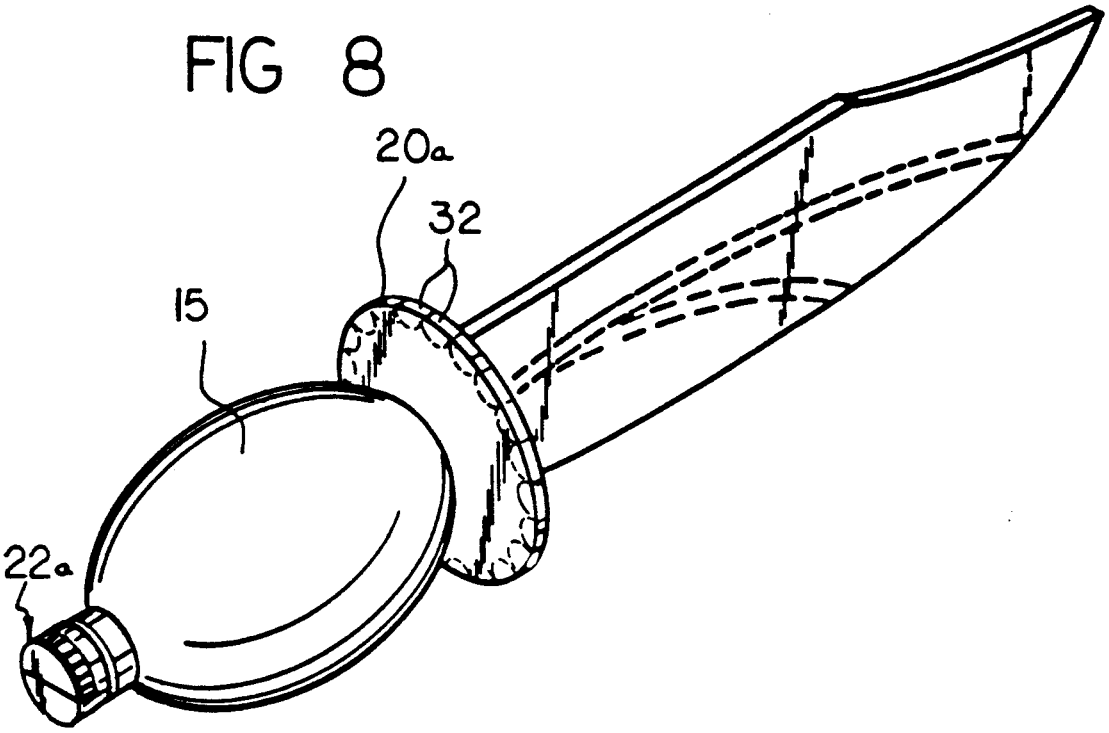
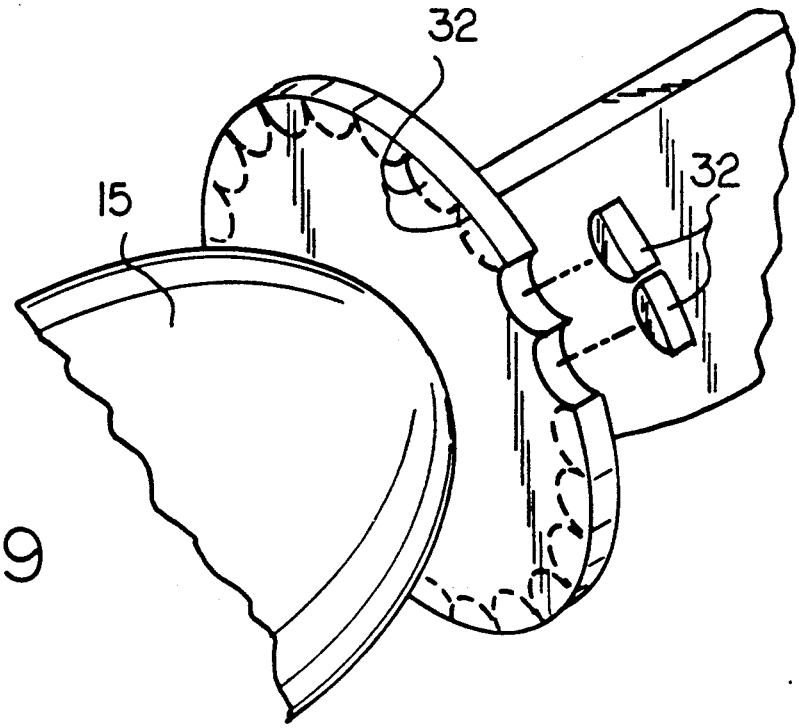
FIG 9

KNIFE

BACKGROUND OF THE INVENTION

1. Field of the Invention

The field of invention relates to novelty knife structure, and more particularly pertains to a new and improved novelty knife wherein the same is arranged to simulate impact upon an individual.

2. Description of the Prior Art

Various novelty knives are utilized throughout the prior art and such is exemplified in U.S. Pat. No. 4,864,759 wherein a toy fire arm is configured as a knife member.

The instant invention attempts to overcome deficiencies of the prior art by providing for a knife member to simulate impact on an individual to direct a fluid simulating blood to be rejecting from the knife member upon impact and in this respect, the present invention substantially fulfills this need.

SUMMARY OF THE INVENTION

In view of the foregoing disadvantages inherent in the known types of knife structure now present in the prior art, the present invention provides a novelty knife structure wherein the same is addressed to express a fluid dye upon compressing of the blade structure and the associated handle reservoir of the invention. As such, the general purpose of the present invention, which will be described subsequently in greater detail, is to provide a new and improved novelty knife which has all the advantages of the prior art knife structure and none of the disadvantages.

To attain this, the present invention provides a novelty knife blade formed of shape retentive material having a bottom edge and a fluid reservoir bulb mounted as a handle, wherein the fluid reservoir bulb includes fluid communication through a plurality of conduits directed through the blade and exiting along the blade's lower edge adjacent the blade's tip, with a fluid dye contained within the reservoir for ease of replenishment.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved novelty knife which has all the advantages of the prior art knife structure and none of the disadvantages.

It is another object of the present invention to provide a new and improved novelty knife which may be easily and efficiently manufactured and marketed.

It is a further object of the present invention to provide a new and improved novelty knife which is of a durable and reliable construction.

An even further object of the present invention is to provide a new and improved novelty knife which is susceptible of a low cost of manufacture with regard to both materials and labor, and which accordingly is then susceptible of low prices of sale to the consuming public, thereby making such novelty knives economically available to the buying public.

Still yet another object of the present invention is to provide a new and improved novelty knife which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an orthographic side view of the instant invention.

FIG. 4 is an orthographic view, taken along the lines 4—4 of FIG. 3 in the direction indicated by the arrows.

FIG. 8 is an isometric illustration of the knife structure utilizing a modified hilt structure.

FIG. 9 is an isometric illustration of the hilt structure illustrating a plurality of discs removed therefrom as indicators.

DESCRIPTION OF THE PREFERRED EMBODIMENT

Figure 1:
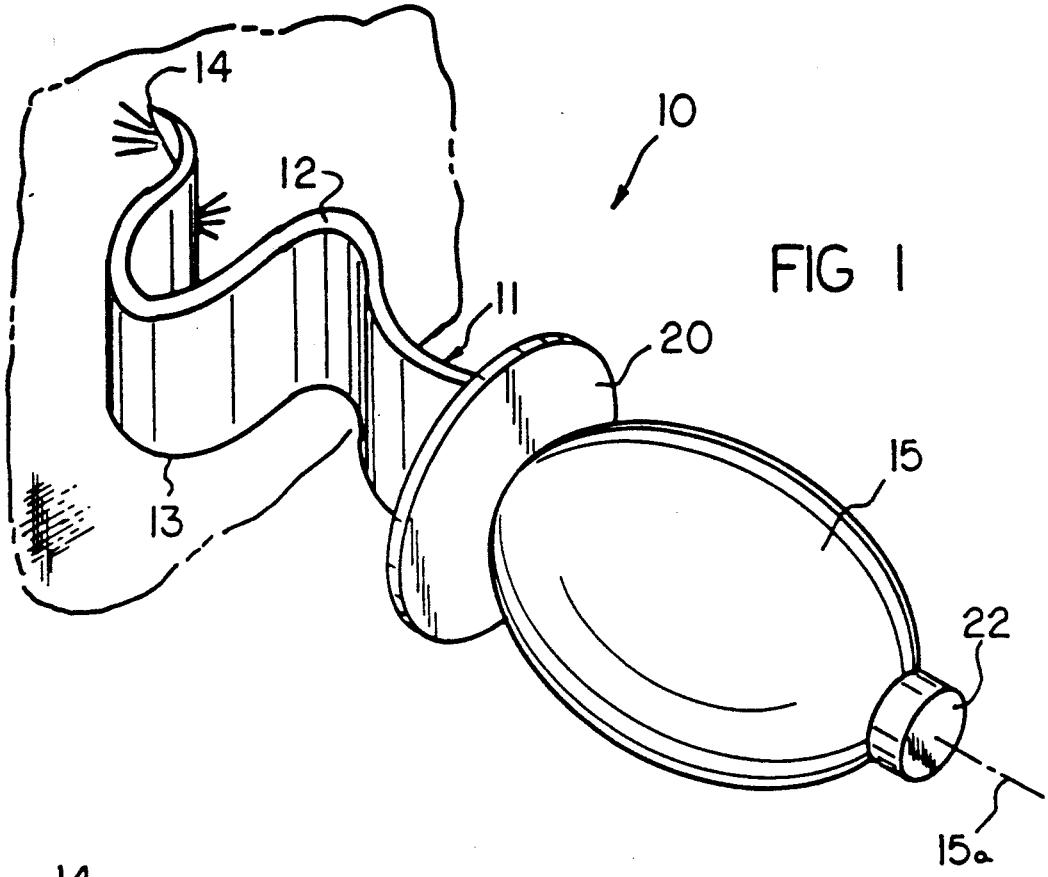
FIG. 1 is an isometric illustration of the instant invention in an operative orientation relative to an object impacted.
Figure 2:
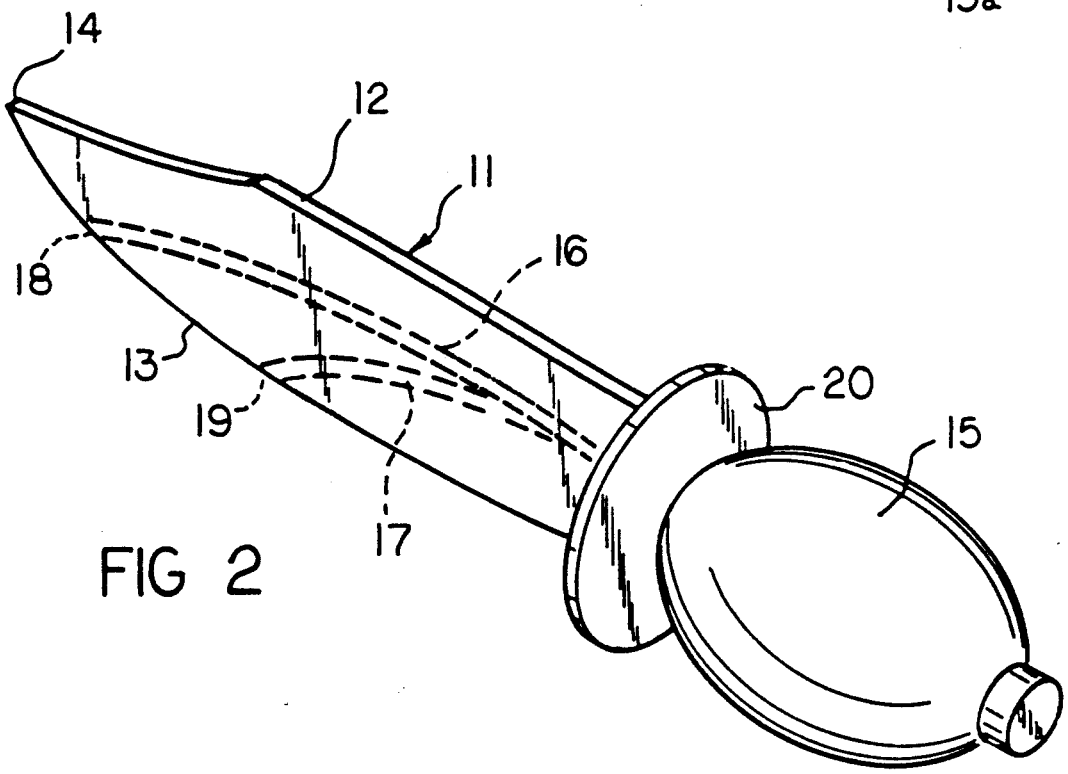
FIG. 2 is an isometric illustration of the invention in a materially relaxed configuration.
Figure 5:
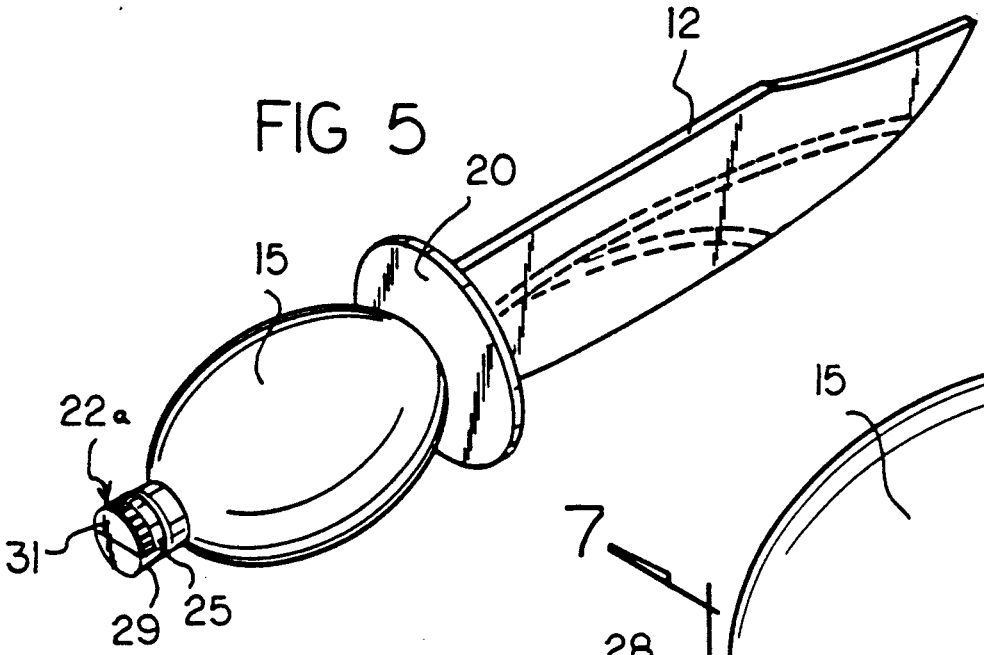
FIG. 5 is an isometric illustration of a modified cap structure of the invention.
Figure 6:
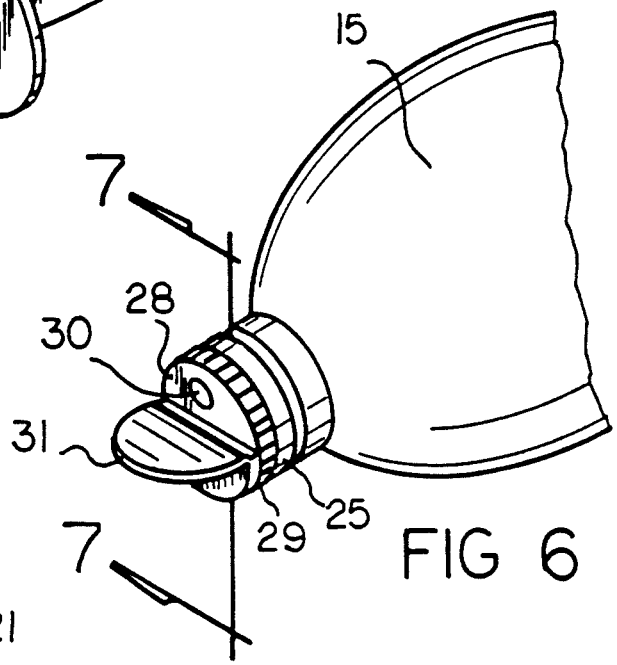
FIG. 6 is an enlarged, isometric illustration of the cap structure.
Figure 7:
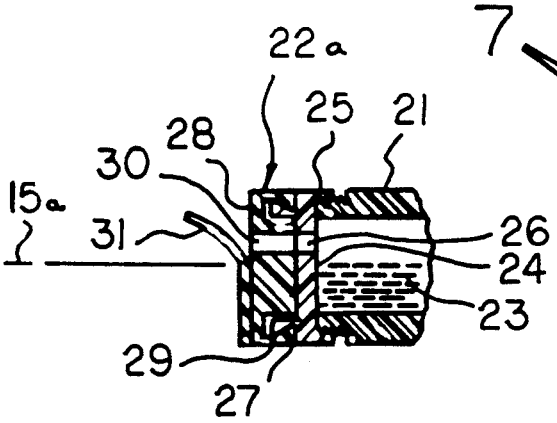
FIG. 7 is an orthographic view, taken along the lines 7—7 of FIG. 6 in the direction indicated by the arrows.

With reference now to the drawings, and in particular to FIGS. 1 to 9 thereof, a new and improved novelty knife embodying the principles and concepts of the present invention and generally designated by the reference numeral 10 will be described.

More specifically, the novelty knife 10 of the instant invention essentially comprises a resilient blade 11 formed of a shape retentive polymeric material, including a blade top edge 12 and a blade lower edge 13 merging together into a forward tip 14. A fluid reservoir bulb handle 15 formed of a shape retentive material and coaxially aligned along an axis 15*a* is in fluid communication with the respective first and second conduits 16 and 17 respectively through the resilient blade and exiting the resilient blade through a respective first and second outlet 18 and 19 that are directed through the blade lower edge adjacent the forward tip in a spaced relationship relative to the tip end. A blade hilt flange 20 is mounted between the fluid reservoir bulb handle 15 and the resilient blade 11.

The fluid reservoir 15 is formed with a reservoir fill conduit 21 coaxially aligned along the axis 15*a*, wherein the bulb handle is generally oriented in a longitudinally aligned relationship relative to the blade 11 having the fill conduit 21 opposed to the hilt flange 20. A fluid dye 23 is contained within the bulb handle 15 and is replenishable through the fill conduit 21 upon removal of a fill conduit cap 22. In this manner, usage of the organization upon projecting the blade upon an impact surface, such as illustrated in FIG. 1, the blade is deformed and simultaneously the bulb handle 15 is compressed to project the fluid dye through the first and second outlets 18 and 19.

A modified cap 22*a* includes a first cap plate 24 having a first cap internally threaded skirt 25 threadedly securable to the fill conduit 21. The first cap plate 24 includes a first cap plate groove 27 projecting above the first cap plate 24. A first aperture 26 directed through the first cap plate 24 is displaced relative to the axis 15*a* and spaced apart a predetermined spacing. A second cap plate 28 is provided in contiguous communication with the first cap plate 24. The second cap plate 28 includes a second cap plate skirt 29 received within the first cap plate groove 27 to permit rotation of the second cap plate 28 relative to the first cap plate 24. A second cap plate aperture 30 directed through the second cap plate is axially displaced relative to the axis 15*a* the predetermined spacing, whereupon rotation of the second cap plate 28 relative to the first cap plate 24, the first aperture 26 is selectively aligned with the second aperture 30. A resilient second cap flange 31 is mounted to the second cap plate 28 and biased selectively over the second aperture 30, whereupon alignment of the first and second apertures permits deflection of the bulb 15 and effects projection of the fluid dye 23 rearwardly through the first and second apertures to be directed upon an unauthorized user of the rotation to thereby dispense the fluid onto the unauthorized user that displaces the resilient second cap flange 31 upon projection of the fluid through the apertures.

The hilt flange 20 is formed in a modified construction 28, as illustrated in FIGS. 8 and 9, formed of semi-cylindrical frangible discs 32 continuously about the periphery of the modified blade hilt flange 20*a* to permit removal of discs 31 to indicate successful utilization of the novelty knife structure to simulate "notches" relative to successful use of the organization.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A novelty knife, comprising, a resilient blade, the resilient blade having a top edge and a lower edge spaced from the top edge, wherein the top edge and the lower edge merge into a forward tip, the blade including a blade hilt flange fixedly mounted orthogonally relative to the resilient blade spaced from the forward tip, and a fluid reservoir bulb handle mounted to the blade hilt flange, with the bulb handle longitudinally aligned along a reservoir axis and the reservoir axis orthogonally oriented relative to the blade hilt flange, and the resilient blade including a first conduit and second conduit directed through the resilient blade in fluid communication with the bulb handle, and the first conduit and second conduit projecting through the blade, with the first conduit terminating in a first conduit outlet and the second conduit terminating in a second conduit outlet, with the first conduit outlet and second conduit outlet directed through the blade lower edge, with the first conduit outlet spaced from the forward tip and the second conduit outlet spaced from the first conduit outlet, and the bulb handle includes a reservoir fill conduit spaced from the hilt flange coaxially aligned along the axis, with the fill conduit including a fill conduit cap removably mounted relative to the fill conduit, and a fluid dye contained within the bulb handle, and the fill conduit cap includes a first cap plate and the fill conduit is externally threaded, the first cap plate including an internally threaded skirt securable to the fill conduit, and the first cap plate including a first aperture directed through the first cap plate, the first aperture spaced relative to the axis a predetermined spacing, and the first cap plate including a first cap plate groove mounted to the first cap plate projecting above the first cap plate, and a second cap plate, the second cap plate including a second cap plate skirt, with the second cap plate skirt received within the first cap plate groove to rotatably mount the second cap plate relative to the first cap plate and the first cap plate in contiguous communication with the second cap plate, and the second cap plate including a second cap plate aperture directed through the second cap plate axially spaced relative to the axis the predetermined spacing to selectively align the first aperture relative to the second aperture.

2. A novelty knife as set forth in claim 1 including a resilient second cap flange mounted to the second cap plate, with the resilient second cap plate flange hingedly mounted relative to the second cap plate to bias the second cap plate flange in communication with the second cap plate and the second aperture, whereupon compressing of the bulb handle upon alignment of the first aperture relative to the second aperture projects the fluid dye through the first aperture and second aperture displacing the resilient flange.

3. A novelty knife as set forth in claim 2 wherein the blade hilt flange includes an outer periphery, and the outer periphery includes a plurality of frangible discs removably mounted relative to the blade hilt flange for indication of use of the novelty knife.

* * * * *